United States Patent [19]

Hansen

[11] Patent Number: 4,840,313

[45] Date of Patent: Jun. 20, 1989

[54] WATER SPRAY FITTING

[75] Inventor: Albert F. Hansen, Whangarei, New Zealand

[73] Assignee: Hansen Development Limited, Whangarei, New Zealand

[21] Appl. No.: 108,495

[22] Filed: Oct. 14, 1987

[30] Foreign Application Priority Data

Oct. 16, 1986 [NZ] New Zealand ..... 217969

[51] Int. Cl.[4] ..... B05B 1/32

[52] U.S. Cl. ..... 239/456

[58] Field of Search ..... 239/456, 457, 458, 460, 239/583, 459

[56] References Cited

U.S. PATENT DOCUMENTS

| | | | |
|---|---|---|---|
| 583,135 | 5/1897 | Wilson | 239/457 |
| 898,759 | 9/1908 | Melavin | 239/458 |
| 3,540,657 | 11/1970 | Thompson | 239/460 X |
| 3,580,513 | 5/1971 | Martin | 239/460 |
| 3,746,262 | 7/1973 | Bete et al. | 239/459 X |

*Primary Examiner*—Andres Kashnikow
*Assistant Examiner*—Kevin P. Weldon
*Attorney, Agent, or Firm*—Hovey, Williams, Timmons & Collins

[57] ABSTRACT

An improved water spray fitting for controlling the flow of water from a pressure supply of water such as a hose or the like is provided which allows more convenient use in maintaining a particular spray pattern while in use. The preferred fitting includes a internally threaded, manually rotatable, control ring located within a transverse cut-out part of the body, and a valve member extending longitudinally through the hollow internal of the fitting body and through the control ring and externally threaded so that rotation of the control ring causes longitudinal movement of the valve member. In preferred use, the control ring can be manually adjusted by the fingers of the hand in which the fitting is held to provide convenient, one-handed operation.

6 Claims, 3 Drawing Sheets

WATER SPRAY FITTING

The invention comprises an improved form of water spray fitting for controlling the flow of water from a pressure supply of water such as a hose or the like.

Water spray fittings typically for domestic garden hoses and the like which may be operated through various positions to control the flow of water from the hose to obtain differing formations of streams of water and/or spray patterns are well known. In opreation of many known forms of fitting it is difficult to adjust the fitting to alter the water flow in use because of back pressure of water acting on the internal components of the fitting. In addition, many known forms of fitting comprise two major body parts which must be rotated one relative to another to adjust the water flow, which is somewhat difficult. Thus adjusting the water flow from a water spray fitting is typically a two handed operation, when otherwise only one hand is generally required to operate a hose such as a garden hose. Some forms of fitting wherein the water flow is controlled by way of a trigger with different positions of the trigger giving different spray patterns are known, and are intended to provide for one handed operation in use, but a difficulty with these forms of fitting is that the trigger must generally be maintained in a set position to maintain a particular spray pattern continuously, which can be difficult in use while watering a garden or washing a car for example.

The present invention provides an improved or at least alternative form of waterspray fitting. Fittings of the invention are suitable for use in domestic garden hose systems but may also be employed in other systems such as irrigation systems or the like.

In broad terms the invention may be said to comprise a water spray fitting for controlling the flow of water from a pressure water supply, comprising:

a body of the fitting adapted to be connected to said water supply and comprising a hollow interior extending from a water inlet to said interior to a water outlet from the fitting;

an internally threaded control ring located in a transverse cut out part of the body of the fitting and rotatable therein about its longitudinal axis by force applied manually to an exposed exterior part or parts of the control ring; and a valve member extending longitudinally within the hollow interior of the fitting and through the control ring and externally threaded in the region of the control ring whereby the valve member is threaded into the control ring such that rotation of the control ring causes longitudinal movement of the valve member within the interior of the fitting, and comprising a distal end engaging the water outlet from the fitting to control the flow of water therefrom on movement of the valve member by way of the control ring and means sealing the valve member to the interior of the fitting on either side of the control ring, and a passage for water internally through the valve member from the water inlet side to the water outlet side beyond the control ring, the valve member being formed such that the forces applied to the valve member in use of the fitting by rearwardly directed water pressure acting on the valve member beyond the control ring and forwardly directed water pressure acting on the valve member on the inlet side thereof are substantially balanced.

Preferably the valve member is formed whereby the surfaces of the valve member on the water inlet and water outlet sides thereof and the areas thereof are such that the forces applied to the valve member by water pressure acting on said surfaces on either side of the valve member are substantially balanced.

With the fitting of the invention the water flow from the fitting is altered by turning the control ring, which in turn moves the valve member within the fitting as will be described. The forces applied to the valve member in typical use by opposing water pressures on either side thereof, such as typical domestic cold water pressures in the case of a domestic type fitting of the invention are substantially balanced so that the control ring may be turned to adjust the fitting without undue difficulty relative to typical prior types of domestic fitting. Moreover, the fitting is adjusted by turning of the control ring which is located in a cut-out in the body of the fitting such that the exterior of the control ring is exposed, so that in many cases in use the control ring will be able to be turned by the fingers of the hand in which the fitting is held. With the fitting of the invention the water flow may generally be adjusted in a one handed operation in use.

Preferably the external diameter of the control ring is substantially the same as the external diameter of the body of the fitting on either side of the control ring to further facilitate ready turning of the control ring with the fingers of the hand in which the fitting is held in use.

A preferred form of the fitting of the invention is illustrated in the accompanying drawings, wherein.

Figure 1:
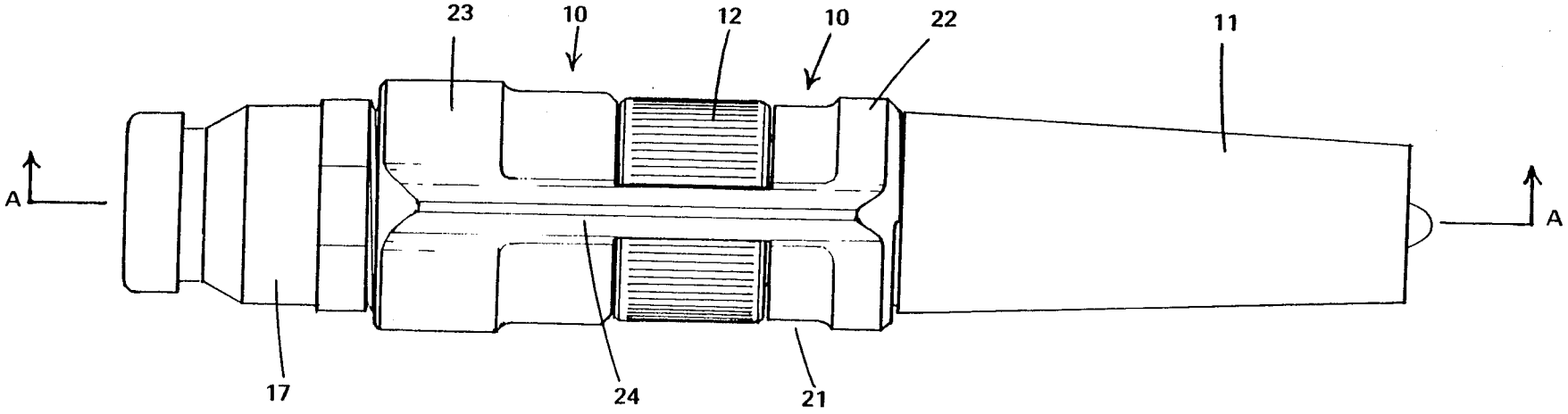
FIG. 1 is a side view of the preferred form fitting.

The preferred form fitting shown in the drawings is intended as a domestic garden hose type fitting. It is constructed essentially as a four part fitting, comprising a body formed by two body parts 10 and 11, a rotatable control ring 12, and a valve member 13 (see FIGS. 2 and 3). The body of the fitting has a hollow interior 40 within which the valve member 13 extends longitudinally as shown. The preferred form fitting and its components are generally circular in cross-sectional shape across the fitting i.e. transverse to the direction of water flow, as will be described. The fitting parts may suitably be formed by injection moulding from a plastics material, for example.

The parts 10 and 11 fit together to form the body of the preferred form fitting with the first part 10 being adapted to be connected to a hose and the second part 11 providing a barrel of the fitting. The parts 10 and 11 may screw together, be a snap fit together, or the like. The body part 10 is open at one end to form a water inlet to the interior of the fitting and this end is formed as a collar 15 internally threaded at 16 to accept a hose connection piece 17. An "O" ring 18 is held within the collar to give a watertight seal between the connection piece 17 and the fitting. Other arrangements for connection of the fitting to a hose or the like could be employed as desired. The interior of the fitting extends from the inlet to a water outlet 42 at the other end of the fitting, which in the preferred form is generally elongate in shape as shown. Other arrangements are possible; the fitting could be formed as a pistol type fitting with the interior being of a right angle shape for example.

Figure 2:
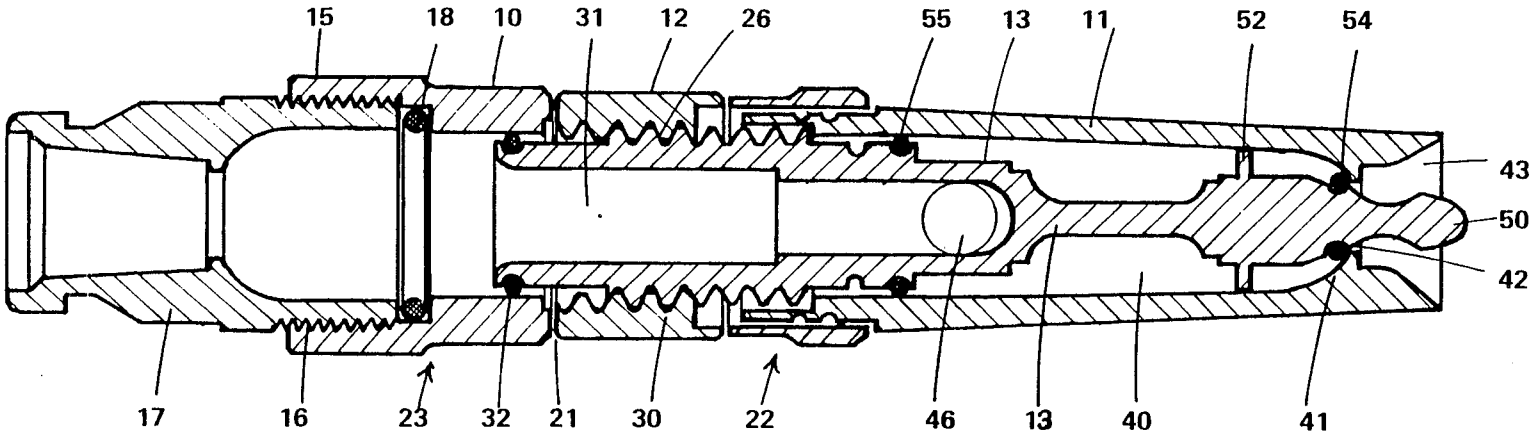
FIG. 2 is a cross-sectional view of the preferred form fitting along line A—A of FIG. 1 showing the fitting adjusted to a minimum flow position.
Figure 3:
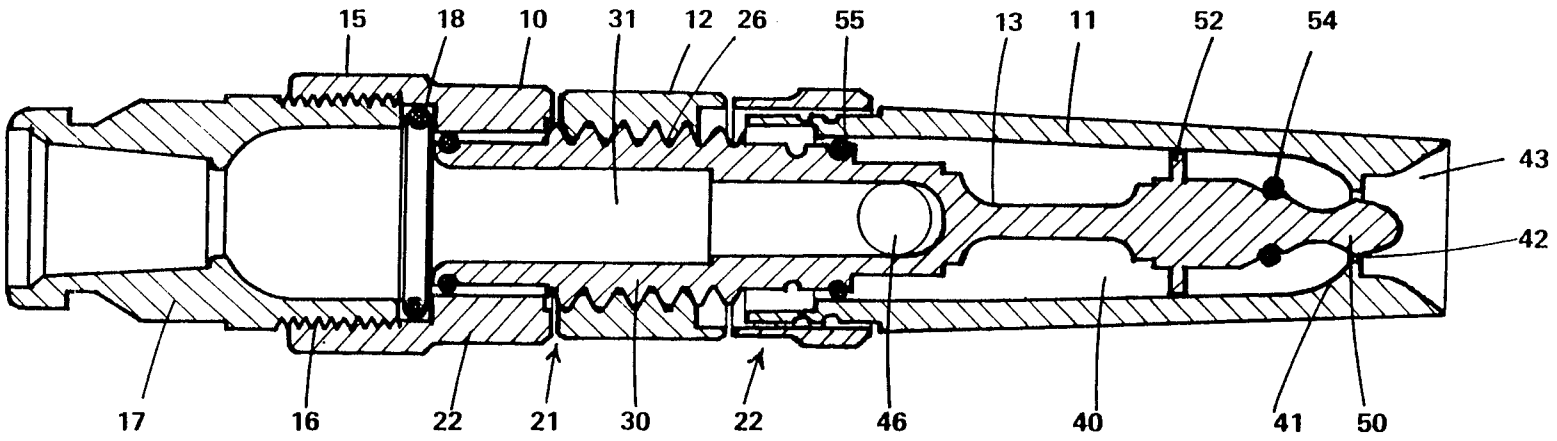
FIG. 3 is a cross-sectional view of the preferred form fitting similar to that of FIG. 2 but showing the fitting adjusted to a maximum flow position.

The fitting body has a cut-out part indicated at 21 extending transversely thereof as shown. The resulting forward part 22 and rear part 23 of the body of the fitting on either side of the cut-out 21 are joined by bridging parts 24 as shown (see FIG. 1). The control ring 12, which is generally circular in external shape, is located in the cut out 21 and is rotatable therein about its longitudinal axis by force applied manually to the exposed exterior of the control ring. The control ring 12 is internally threaded at 30 as shown in FIGS. 2 and 3. The exterior of the control ring is formed as a gripping surface as indicated in FIG. 1. It is preferred that, as shown, the external diameter of the control ring is substantially the same diameter as the external diameter of the body of the fitting on either side thereof.

The valve member 13 extends through the control ring 12 and is externally threaded in the region of the control ring as indicated at 26 whereby the valve member is threaded into the control ring as shown. With the control ring held captive in the cut-out 21 against all but rotational movement about its longitudinal axis the arrangement is such that rotational movement of the control ring 12 causes longitudinal movement of the valve member 13 within the interior of the fitting. The valve member may be moved either way dependent on the direction of rotation of the control ring. The distal end 50 of the valve member engages the outlet 42 of the fitting to control the flow of water therefrom and in the preferred form the distal end 50 extends into the outlet 42 and is shaped to co-operate therewith, such that the pattern of spray from the fitting is dependent upon the position of the distal end 50 therein. A flared part 43 of the body extends beyond the outlet 42 as shown to assist in this regard. In the preferred form an "O" ring 54 is provided within a suitable annular groove adjacent the distal end of the valve member so that when the valve member is in its most forward minimum flow position, as indicated in FIG. 2, the "O" 54 ring will bear against the wall 41 adjacent the outlet 42 to close the fitting against the flow of water completely. Towards the distal end 50 of the valve member the valve member comprises a plurality of spaced apart stabilising lugs 52 extending radially to contact the walls of the interior of the fitting as shown, to assist in centering the distal end 50 of the valve member.

The control ring may be rotated to vary the longitudinal placement of the valve member 13 within the interior 40 of the fitting, and of the distal end 50 within the outlet 42. Through rotation of the control ring the valve member can be moved from any position from the closed position as indicated in FIG. 2 to the fully open position as indicated in FIG. 3.

The valve member 13 comprises means sealing the valve member to the interior of the fitting on either side of the cut-out 21 and control ring 12, in the preferred form in the form of O-rings 32 and 55 provided in suitable annular grooves formed in the valve member. The "O" rings 32 and 55 provide a watertight seal whilst still allowing movement of the valve member longitudinally within the interior of the fitting as described. The valve member 13 includes a passage 31 for water internally through the valve member from the water inlet side of the interior of the body to the water outlet side thereof, beyond the control ring 12. On the water inlet side the passage 31 is open in an entry to the passage as shown and on the water outlet side ports 46 communicate the passage to the exterior of the valve member.

The arrangement described is such that in use water may flow from the water inlet to the fitting, through the passage 31 and the ports 46 to the water outlet side, to exit the water outlet 42. The positioning of the valve member and particularly of the distal end 50 thereof in the water outlet 42 will determine the stream or spray pattern of water flowing from the fitting and by rotation of the control ring the shape and pattern of the spray or stream may be altered/controlled. When the valve member 13 is in its fully rearward position as shown in FIG. 3, the water will exit the fitting as a stream, while as the valve member 13 is moved towards its fully forward position shown in FIG. 2 where the flow of water from the outlet is closed off, different shapes of spray are achieved.

The valve member 13 is formed such that the forces applied to the valve member by rearwardly directed water pressure acting on the valve member 13 beyond the control ring 12 and forwardly directed water pressure acting on the valve member on the water inlet side thereof are substantially balanced for typical situations. In the preferred form the rearwardly facing surfaces of the valve member on the water inlet side and the forwardly facing surfaces on the water outlet side are formed and shaped and are of areas such that the forces applied to the valve member 13 through these surfaces by water pressure contacting the valve member on either side of the control ring are substantially balanced. Thus, movement of the valve member 13 through rotation of the control ring 12 is not significantly hindered by the valve member 13 being required to move against a large or unopposed back pressure as in many prior fittings, and adjustment of the fitting in use is thus easier. Further the arrangement of the control ring in a cut-out part of the body of the fitting enables ready adjustment of the fitting by turning of the control ring, which will often be possible with the fingers of the hand holding the fitting in use.

The foregoing describes the invention including a preferred form thereof. Alterations and modifications as will be obvious to those skilled in the art are intended to be incorporated within the scope hereof, as defined in the following claims.

I claim:

1. A water spray fitting for controlling the flow of water from a pressure water supply, comprising:

a body of said fitting adapted to be connected to said water supply and comprising a hollow interior extending from a water inlet to said interior to a water outlet from said fitting;

an internally threaded control ring located in a transverse cut out part of said body and rotatable therein about its longitudinal axis by force applied manually to an exposed exterior part or parts of said control ring; and a valve member extending longitudinally within said hollow interior and through said control ring and externally threaded in the region of said control ring such that rotation of said control ring causes longitudinal movement of said valve member within said hollow interior, and comprising a distal end engaging said water outlet to control the flow of water therefrom on movement of said valve member by way of said control ring, and means sealing said valve member to the interior of the fitting on either side of said control ring, and a passage for water internally through said valve member from the water inlet side of said interior through a water outlet port of the member to the water outlet side of the body beyond said control ring, said valve member being formed such that the forces applied to said valve member in use of the fitting by rearwardly directed water pressure acting on said valve member beyond said control ring and forwardly directed water pressure acting on said valve member on said inlet side thereof are substantially balanced.

2. A water spray fitting as claimed in claim 1, wherein said body of the fitting is of a generally elongate shape comprising at one end means for connection of the fitting to said pressure water supply and said water inlet, and wherein said valve member extends longitudinally within said interior of said body substantially between said water inlet and said water outlet and wherein said passage through said valve member is open at one end of said valve member on the water inlet side of said interior in an entry to said passage and includes a plurality of ports communicating said passage to the exterior of said valve member through said water outlet.

3. A water spray fitting as claimed in claim 2, wherein a part of said valve member between said ports and said distal end thereof is of reduced diameter relative to the interior or said fitting, and wherein near said distal end said valve member comprises a plurality of spaced apart stabilising lugs extending radially to contact the walls of said interior.

4. A water spray fitting as claimed in claim 3, wherein said hollow interior is generally circular in cross-sectional shape and wherein said means sealing said valve member to said hollow interior comprises resilient o-rings carried by said valve member on either side of said control ring.

5. A water spray fitting as claimed in any one of claims 1, 2, 3 or 4, wherein the external diameter of said control ring is substantially the same as the external diameter of said body on either side of said control ring.

6. A water spray fitting as claimed in any one of claims 1, 2, 3, or 4, wherein said fitting is substantially a four part fitting comprising said valve member, said control ring, and two parts comprising said body, a first of said body parts being adapted to be connected to said pressure water supply and housing said control ring and the second of said parts being adapted to be connected to said first part to form said body and providing a barrel of said fitting terminating in said water outlet.

* * * * *